US008403627B2

(12) United States Patent
Hartmann et al.

(10) Patent No.: US 8,403,627 B2
(45) Date of Patent: Mar. 26, 2013

(54) WATER PUMP FOR PUMPING COOLANT IN A LOW TEMPERATURE AND IN A HIGH TEMPERATURE CIRCUIT

(75) Inventors: Michael Hartmann, Bermatingen (DE); Manfred Sulzmann, Meckenhausen (DE)

(73) Assignee: MTU Friedrichshafen GmbH, Friedrichshafen (DE)

( * ) Notice: Subject to any disclaimer, the term of this patent is extended or adjusted under 35 U.S.C. 154(b) by 702 days.

(21) Appl. No.: 12/590,731

(22) Filed: Nov. 14, 2009

(65) Prior Publication Data

US 2010/0143109 A1 Jun. 10, 2010

(30) Foreign Application Priority Data

Dec. 10, 2008 (DE) ..... 10 2008 061 407

(51) Int. Cl.
*F04D 1/00* (2006.01)
*F04D 29/22* (2006.01)
*F04D 29/58* (2006.01)

(52) U.S. Cl. .... 415/98; 415/101; 415/173.5; 415/199.1; 415/206

(58) Field of Classification Search ..... 415/98, 415/99, 101, 102, 173.1, 173.5, 174.5, 199.1, 415/206

See application file for complete search history.

(56) References Cited

U.S. PATENT DOCUMENTS

| | | | | |
|---|---|---|---|---|
| 1,743,348 | A * | 1/1930 | Hollander | 415/98 |
| 2,944,785 | A * | 7/1960 | Sampietro | 415/170.1 |
| 3,045,427 | A * | 7/1962 | Baize et al. | 415/174.5 |
| 4,061,187 | A * | 12/1977 | Rajasekaran et al. | 60/599 |
| 4,941,801 | A * | 7/1990 | Takakura | 415/170.1 |
| 6,447,244 | B1 * | 9/2002 | Clements | 415/206 |

FOREIGN PATENT DOCUMENTS

DE 41 14 704 2/1992

* cited by examiner

*Primary Examiner* — Igor Kershteyn
(74) *Attorney, Agent, or Firm* — Klaus J. Bach

(57) ABSTRACT

In a water pump for pumping coolant in a low temperature and a high temperature circuit with low temperature and high temperature housings each including a spiral flow guide structure, and a single rotor disposed in the joined housings and having a low temperature rotor part for pumping coolant through the low temperature circuit and a high temperature rotor part for pumping coolant through the high temperature circuit, the housings are joined with a heat isolating structure disposed between the flow guide structures of the high temperature and the low temperature housings to limit heat transfer from the high temperature coolant pumped through the high temperature housing to the low temperature coolant pumped through the low temperature housing.

7 Claims, 2 Drawing Sheets

WATER PUMP FOR PUMPING COOLANT IN A LOW TEMPERATURE AND IN A HIGH TEMPERATURE CIRCUIT

BACKGROUND OF THE INVENTION

The invention resides in a water pump for pumping coolant in a low temperature and in a high temperature circuit including a low temperature housing with an internal low temperature housing, a high temperature housing with an internal high temperature spiral, a water pump impeller for pumping at the same time coolant in the low temperature housing spiral and in the high temperature housing spiral, and a drive shaft for driving the water pump impeller.

DE 41 14 704 C1 discloses a cooling circuit for two-stage charge air cooling. The cooling circuit comprises, a high-temperature and a low-temperature circuit. In the high temperature circuit, in series, a high temperature heat exchanger, a high temperature charge air cooler provided as a first cooling stage, a water pump for circulating coolant in the high-temperature circuit and the internal combustion engine are arranged. In the low temperature circuit, in series, a low-temperature heat exchanger, a low temperature charge air cooler forming a second cooling stage, an engine-oil heat exchanger, a transmission fluid heat exchanger and a second water pump for circulating coolant in the low-temperature circuit are arranged.

In praxis, the first and the second coolant pumps are double suction pumps disposed on a common drive shaft in a two-part housing. In order to keep the weight and the power requirements of the coolant pumps low, the housing and the coolant pump rotors consist of aluminum. In order to further reduce weight, the coolant pump rotor for circulating coolant in the low-temperature circuit is formed integrally with the coolant pump rotor for circulating the coolant in the high-temperature circuit. It is noted however that, with the good heat conductivity of the aluminum and the temperature difference between the high temperature and the low temperature circuit of for example 40° C., an undesirable heat transfer occurs between the two cooling circuits. This heat transfer can be compensated for in the low temperature circuit only by an increased heat removal for example via larger heat exchangers.

It is the object of the present invention to provide a water pump for pumping coolant in a low temperature and a high temperature coolant circuit in which the heat transfer via a common pump rotor is reduced.

SUMMARY OF THE INVENTION

In a water pump for pumping coolant in a low temperature and a high temperature circuit with low temperature and high temperature housings each including a spiral flow guide structure, and a single rotor disposed in the joined housings and having a low temperature rotor part for pumping coolant through the low temperature circuit and a high temperature rotor part for pumping coolant through the high temperature circuit, the housings are joined with a heat isolating structure disposed between the flow guide structures of the high temperature and the low temperature housings to limit heat transfer from the high temperature coolant pumped through the high temperature housing to the low temperature coolant pumped through the low temperature housing.

In the assembled water pump a first plane is defined between the high temperature and the low temperature spiral by a first mounting surface formed on the low-temperature housing and an abutting adjacent mounting surface which is formed on the high-temperature housing. In this first plane, a heat insulation structure consisting for example of a stainless steel sheet is arranged.

For reducing the heat transfer at the water pump rotor itself, the rotor consist of a low-temperature rotor part and a high temperature rotor part joined with an insulating gap which is arranged therebetween and forms a heat barrier. The connecting area between the rotor parts defines a second plane which, generally coincides with the first plane, that is, the two planes are in radial alignment.

It has been determined in test measurements that, with the measures according to the present invention, the heat flow from the high temperature to the low temperature circuit could be reduced by up to 70%. Since, as a result, less heat energy reaches the low temperature circuit, either the cooling system may be made smaller, lighter and less costly or the temperature level in the low-temperature circuit may be kept at a lower level which is advantageous for example for the cooling of electronic components.

The invention will become more readily apparent from the following description of a preferred embodiment thereof on the basis of the accompanying drawings.

DETAILED DESCRIPTION OF A PREFERRED EMBODIMENT

Figure 1:
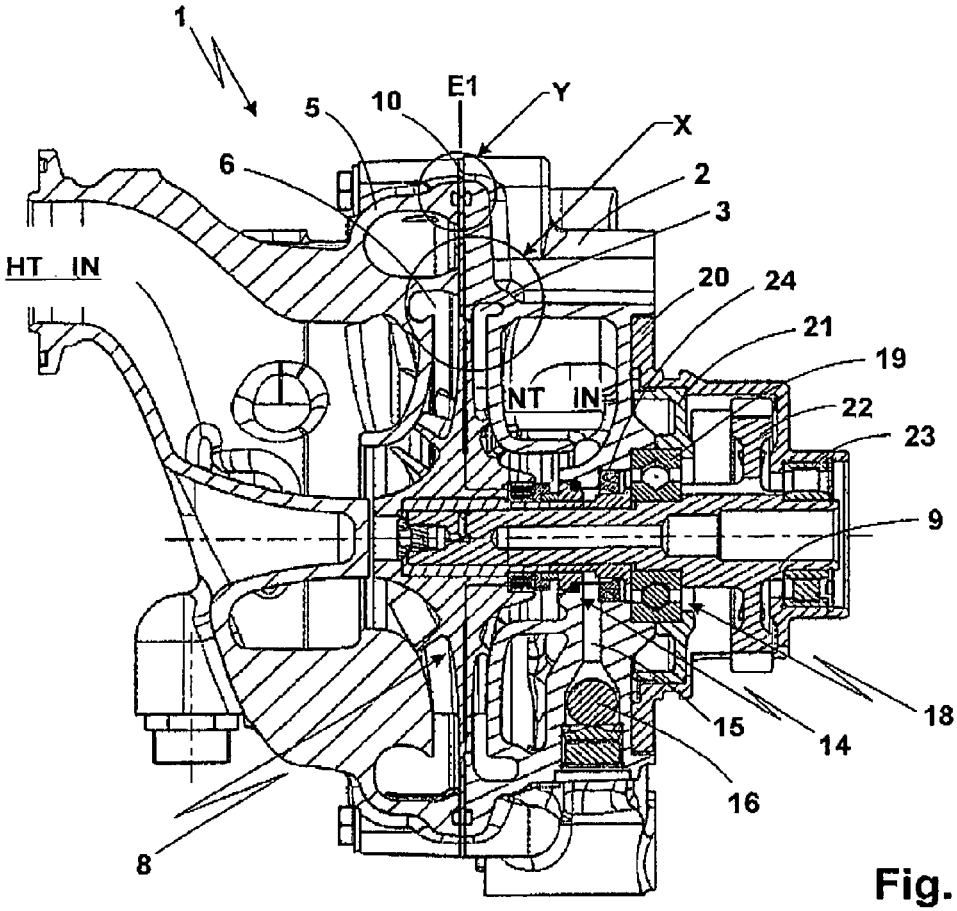
FIG. 1 is a sectional view of the water pump according to the invention.
Figure 1X:
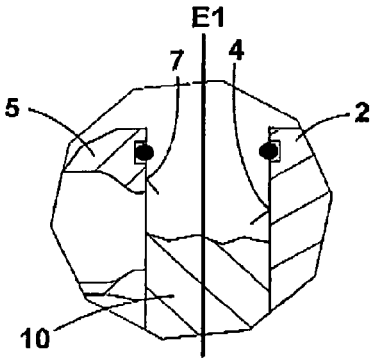
FIG. 1X is an enlarged view of the section X as circled in FIG. 1.
Figure 1Y:
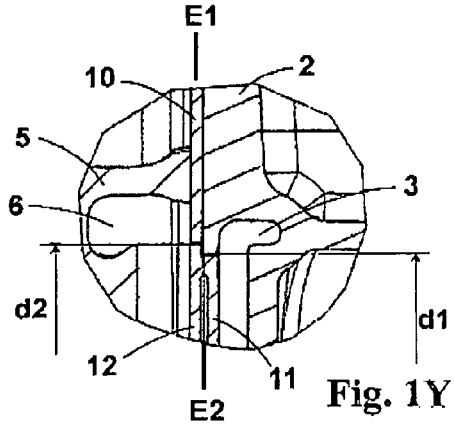
FIG. 1Y is an enlarged view of the section Y as circled in FIG. 1.
Figure 2:
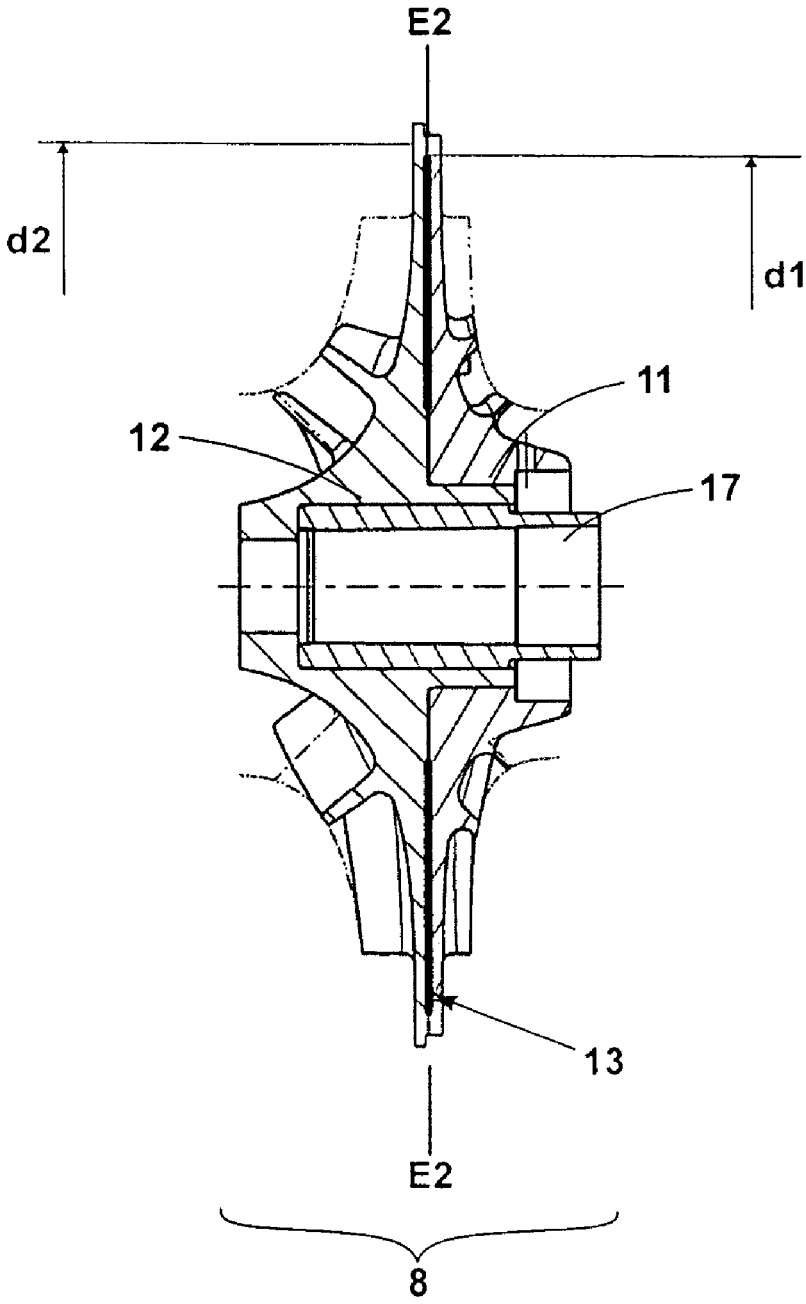
FIG. 2 is a sectional view of the water pump rotor.

FIG. 1 shows a water pump 1 with details X and Y all shown in sectional views. The detail X (FIG. 1X) shows enlarged an area of the water pump rotor. The detail Y (FIG. 1Y) shows enlarged the connecting area of the pump housings at the outer circumference of the water pump. FIG. 2 shows the water pump rotor in a sectional view. The following description is provided referring to all the figures, FIG. 1, FIG. 1*x*, FIG. 1Y and FIG. 2.

The water pump as shown in FIG. 1 pumps coolant in a low temperature cooling circuit and, at the same time, coolant in a high-temperature circuit. The water pump 1 comprises the following main design groups: a low temperature housing 2, a high-temperature housing 5, a water pump rotor 8 for pumping the coolant, a drive shaft 9 for driving the water pump rotor 8 and a first bearing housing 20. In the low temperature housing 2, a low temperature spiral passage 3 is provided. The inlet of the low temperature coolant housing is designated in FIG. 1 by the reference sign NT IN. As shown in detail in FIG. 1Y, a first mounting surface 4 is formed at an end face of the low temperature housing 2. The high temperature housing 5 includes a high temperature spiral guide structure 6. The inlet of the high temperature coolant is marked in FIG. 1 by the reference sign HT IN. At its front end, see FIG. 1Y, the high temperature housing 5 is provided with a second mounting surface 7.

A drive torque is supplied to the drive shaft 9 via a gear wheel 22, which is formed integrally with the drive shaft 9. The drive shaft 9 drives the water pump rotor 8. The drive shaft 9 is radially and axially supported in the low temperature housing 2 by way of a cone ball bearing 18 and, via a cylindrical roller bearing 23, by the bearing housing 20, see FIG. 1. The ball bearing 18 is rendered play-free by the application of an axial force by the first bearing housing 20 via a second bearing housing 21 which is resilient, so that it acts as a spring engaging the outer housing ring 19 of the conical ball, bearing 18.

By means of a shaft seal ring 24 and a friction seal ring connection 14, the low temperature housing 2 and the drive shaft 9 are sealed relative to one another. For the removal of leakages, a leakage bore 15 with an elastomer ball 16 is arranged in the low temperature housing 2. The elastomer ball 16 is movably disposed in the leakage channel 15 and forms a one-way valve which prevents, upon flow reversal, any water from entering the water pump for example during underwater operation.

During operation, there is a temperature difference between the high-temperature and the low temperature circuit of up to 40° C. Since the housings of the water pump 1 and the water pump rotor 8 consist of aluminum, heat is transferred from the hotter medium (high temperature) to the cooler medium (low temperature) via the housing of the water pump and via the rotor. For reducing the heat transfer two measures are provided.

The first measure serves to reduce the heat transfer from the high temperature housing 5 to the low-temperature housing 2. To this end, there is a first separation plane E1 defined between the first assembly surface 4 of the low temperature housing 2 and the second assembly surface 7 of the high temperature housing 5 and between the low temperature spiral duct structure 3 and the high temperature spiral duct structure 6. As shown in FIGS. 1 and 1Y, the two assembly surfaces 4 and 7 are disposed in engagement with each other via an intermediate heat insulator 10. As heat insulator 10, typically a stainless steel sheet or plastic material insert may be used. Additionally, the heat insulator 10 may be coated by a sealing material.

The second measure serves to reduce the heat transfer within the water pump rotor 8. To this end, the water pump rotor 8 comprises a low-temperature rotor part 11 and a high-temperature rotor part 12 with an intermediate insulation gap 13 disposed therebetween, see FIG. 2. The water pump rotor 8 is mounted on the drive shaft 9 via a steel sleeve 17 which is mounted to the drive shaft 9 by a press-fit. The low temperature rotor part 11 pumps the coolant in the low-pressure circuit via the low temperature spiral guide structure 3. The high temperature rotor 12 pumps the coolant in the high temperature circuit via the high temperature spiral guide structure 6. The radially extending isolation gap 13 is formed by a corresponding shaping of the adjacent backsides of the rotor parts 11 and 12. The back side is the side of the rotor part opposite the pump blades. The low temperature rotor part 11 and the high-temperature rotor part 12 are interconnected in a fluid-tight manner for example by cementing or by welding, particularly by electron beam welding. During the welding procedure, the insulation gap 13 is evacuated so that it forms a highly effective heat barrier because of the fluid tight evacuated space provided by this procedure. With the fluid-tight cementing an air-filled isolation gap remains which in this case forms the heat barrier. The connection area of the low-temperature rotor part 11 and the high temperature rotor part 12 defines a second plane E2 (FIG. 2). In a first embodiment, the second plane E2 coincides with the first plane E1 which is defined by the first and the second mounting surface area. In a second embodiment, see FIG. 1X, the diameter d1 of the low temperature rotor part 11 is smaller than the diameter d2 of the high temperature rotor part 12. By a corresponding contour of the low temperature housing 2 and the high temperature housing 5 a labyrinth seal structure is formed. However, a mirror-reversed arrangement of the labyrinth seal structure is also possible that is that d1 is larger than d2. In the second embodiment then the second plane E2 is axially displaced with respect to the first plane E1 by half the width of the labyrinth seal so as to form the labyrinth structure.

The water pump according to the present invention has the following advantages:

The heat transfer from the high temperature to the low temperature circuit is substantially reduced, in the test example by up to 70%.

The heating of the low temperature circuit is reduced so that the cooling system can be made smaller, lighter and at lower costs.

Alternatively, the low temperature circuit can be operated at a lower temperature level whereby the cooling for example of electronic components is improved.

| Listing of Reference Numerals | |
|---|---|
| 1 | Water pump |
| 2 | Low temperature housing |
| 3 | Low temperature spiral fluid guide structure |
| 4 | First mounting surface |
| 5 | High temperature housing |
| 6 | High temperature spiral fluid guide structure |
| 7 | Second mounting surface |
| 8 | Water pump rotor |
| 9 | Drive shaft |
| 10 | Heat insulator |
| 11 | Low temperature rotor part |
| 12 | High temperature rotor part |
| 13 | Isolation gap |
| 14 | Friction ring seal structure |
| 15 | Leakage bore |
| 16 | Elastomer ball |
| 17 | Steel sleeve |
| 18 | Cone-like ball bearing |
| 19 | Outer ring |
| 20 | First bearing housing |
| 21 | Second bearing housing |
| 22 | Gear |
| 23 | Cylinder roller bearing |
| 24 | Shaft seal |
| E1 | First plane |
| E2 | Second plane |
| d1 | Low temperature rotor part diameter |
| d2 | High temperature rotor part diameter |

What is claimed is:

1. A water pump (1) for pumping coolant in a low temperature and in a high temperature circuit comprising:

a low temperature housing (2) including an internal low temperature spiral flow guide structure (3) and having a first mounting surface (4) extending in a first plane (E1), a high temperature housing (5) including an internal high temperature spiral flow guide structure (6) and having a second mounting surface (7), a water pump rotor (8) for concurrently pumping low temperature coolant in the low temperature housing (2) via the low temperature spiral structure (3) through the low temperature circuit and high temperature coolant in the high temperature housing (5) via the high temperature spiral structure (6) through the high temperature circuit, the water pump rotor (8) comprising a low temperature rotor part (11) for pumping the coolant in the low temperature circuit and a high temperature rotor part (12) for pumping the coolant in the high temperature circuit, the low temperature rotor part (11) and the high temperature rotor part (12) being firmly joined to each other with a radially extending isolating gap (13) formed therebetween and a drive shaft (9) for driving the water pump rotor (8), and the first mounting surface (4) and the second mounting surface (7) being joined along the first plane (E1) with an intermediate heat isolator (10) disposed between the low temperature spiral flow guide structure (3) and the high, temperature spiral flow guide structure (6).

2. The water pump according to claim 1, wherein the low temperature rotor part (11) and the high temperature rotor part (12) are tightly joined along a second plane (E2) which coincides with the first plane (E1), and the isolating gap (13) formed therebetween is evacuated.

3. The water pump according to claim 1, wherein for forming a labyrinth seal between the low and high temperature housings (2, 5), the diameter (d1) of the low temperature rotor part (11) is smaller than the diameter (d2) of the high temperature rotor part (12).

4. The water pump according to claim 3, wherein the low temperature rotor part (11) and the high temperature rotor part (12) are joined along a second plane E2 which is axially spaced from the first plane E1 by half the width of the isolating gap, providing for the labyrinth seal around the water pump rotor (8).

5. The water pump (1) according to claim 1, wherein between the low-temperature housing (2) and the drive shaft (9), a friction ring seal structure (14) as well as a shaft seal (24) are arranged, a discharge bore (15) for discharging leakage from the friction ring seal structure (14) and from the shaft seal (24) is formed in the low temperature housing (2) and a movable elastomer ball (16) is arranged in the leakage bore (15) for closing the leakage bore (15) so as to permit fluid flow only out of the leakage bore (15).

6. The water pump (1) according to claim 1, wherein a steel sleeve (17) is arranged between the water pump rotor (8) and the drive shaft (9).

7. The water pump (1) according to claim 6, wherein the drive shaft (9) is supported in the low temperature housing (2) by a ball bearing (18) having an outer ring (19) which abuts axially the low temperature housing (2) and is resiliently biased axially into play-free engagement with the low temperature housing (2) by a first bearing housing (20) and a resilient second bearing housing (21) axially resiliently engaging the outer bearing ring (19).

* * * * *